United States Patent [19]

Buhrer

[11] 4,450,385

[45] May 22, 1984

[54] INDUCTIVE BALLASTING OF DIRECT CURRENT GAS DISCHARGES

[75] Inventor: Carl F. Buhrer, Framingham, Mass.

[73] Assignee: GTE Laboratories Incorporated, Waltham, Mass.

[21] Appl. No.: 406,601

[22] Filed: Aug. 9, 1982

[51] Int. Cl.[3] ..... H05B 41/16

[52] U.S. Cl. ..... 315/205; 315/208; 315/283; 315/DIG. 7; 315/307; 363/88

[58] Field of Search ..... 315/205, 208, 283, 307, 315/DIG. 7; 363/75, 88, 90, 136

[56] References Cited

U.S. PATENT DOCUMENTS

| | | | |
|---|---|---|---|
| 3,305,763 | 2/1967 | Kupferberg et al. | 363/88 X |
| 3,813,594 | 5/1974 | Toth | 363/88 |
| 4,356,433 | 10/1982 | Linden | 315/208 X |

*Primary Examiner*—Eugene R. LaRoche

*Attorney, Agent, or Firm*—J. Stephen Yeo

[57] ABSTRACT

A ballast circuit for direct current gaseous electrical discharge devices includes a rectifying bridge, and an inductive ballast for storing excess energy. The rectifying bridge uses a pair of thyristors which must be gated on for the bridge to supply rectified voltage to the inductor and device. Gating is delayed at the beginning of each half-cycle to allow the inductor to discharge most of its stored energy.

3 Claims, 2 Drawing Figures

INDUCTIVE BALLASTING OF DIRECT CURRENT GAS DISCHARGES

BACKGROUND OF THE INVENTION

This invention pertains to ballast circuits for gaseous electrical discharge devices, and more particularly, is concerned with inductive ballast circuits for direct current discharge devices.

Gaseous electrical discharges are found in a number of commercially important devices, particularly those used for artificial lighting. Most of the electrical discharge lamps in use today are powered by alternating current power mains via a ballasting device that supplies a controlled alternating current to the discharge. The ballasting device essentially places an inductive impedance in series with the lamp. This is necessary because the discharge lamps usually have a negative impedance characteristic which would lead to destructive current excursions if they are connected to a low impedance voltage source.

Operation of these lamps with an alternating discharge current necessitates some degree of compromise in electrode design because each electrode must alternately serve as anode and cathode. Some lamp designs being considered for commercial lighting application are to be operated with a unidirectional current in the discharge. The ballasting of such a direct current discharge lamp requires a circuit that gives the necessary current control without excessive power dissipation in the ballasting device. For this reason, the use of a series resistor as a ballast is clearly unsatisfactory as the voltage drop across the resistor and the associated power dissipation gives a low ballast-lamp system efficiency.

The act of merely substituting an inductor for a resistor raises other problems. For example, the circuit shown in FIG. 1 shows a dc discharge device 10 with an anode 11 and heated cathode 12. Power for heating the cathode is provided by a separate supply means 15. Inductor 16 is in series with the discharge and carries full wave rectified current from the diode bridge rectifier 17, the input of which is connected by terminals 18 and 19 to the ac power mains supplying, for example, 120 volts at 60 Hz. The discharge device contains a low pressure inert gas plus mercury vapor fill and if phosphor-coated on the inside of the envelope would be a fluorescent-type lamp. The electrical characteristic of such a low pressure discharge is such that it maintains an essentially constant voltage drop over a wide range of discharge currents, the voltage value depending on the discharge tube geometry and the composition of the gas fill. The operation of the simple ballast circuit of FIG. 1 depends on the relation between the input line voltage and the lamp voltage drop. In particular, if the average value of the voltage output from the full wave rectifier, that is its dc component, exceeds the device voltage drop, the discharge current will not be interrupted between successive half-cycles of the ac power line, the moreover, the dc component of lamp current resulting from the excessive dc component of the bridge output relative to the device voltage will be limited only by the dc resistance that may be present in the winding of the inductor 16. Another way to describe the difficulty with the circuit of FIG. 1 is to consider the buildup of energy stored in inductor 16. As the instantaneous output voltage from rectifier bridge 17 exceeds the device voltage drop, the lamp discharge begins to conduct current with a rate of increase in current proportional to the voltage across inductor 16. The current continues to increase until the rectifier output falls below the device voltage. Then the decreasing current induces an opposite polarity across the inductor which now adds to the rectifier output so as to equal the device voltage drop. Energy flows out of the inductor during the time interval near the zero crossing of the ac power line. If the energy has not been completely dissipated before the cycle repeats, there will be a net increase of stored energy and inductor discharge current per half-cycle of the ac line power and the cumulative effect will be an uncontrolled direct current increase resulting in possible component or device failure.

SUMMARY OF THE INVENTION

Accordingly it is an object of the invention to provide for the discharge of the inductor at the end of each half-cycle.

Briefly, a ballast circuit includes an inductor for series connection to a gaseous discharge device. Rectified voltage is provided by a rectifier bridge comprised of two thyristors and two diodes. The thyristors are arranged to be conductive on alternate half-cycles of the ac power supply. If, however, the inductor has an excessive amount of energy stored at the end of a half-cycle, the conduction is delayed until the excess energy decays.

A resistor in series with the inductor has a voltage drop proportional to discharge current from the inductor. If the voltage across this resistor exceeds a predetermined value, current to gate of a thyristor is diverted, thereby preventing thyristor turn-on until the discharge current and the corresponding resistor voltage drops below the predetermined value. The gate current may be diverted by a pair of diodes connecting the gate of a corresponding thyristor to the junction of the resistor and inductor. The diodes bypass gate to cathode current flow when their forward voltage drop is less than the combined voltage drop of the resistor and the corresponding thyristor gate to cathode voltage.

DESCRIPTION OF THE INVENTION

Figure 2:
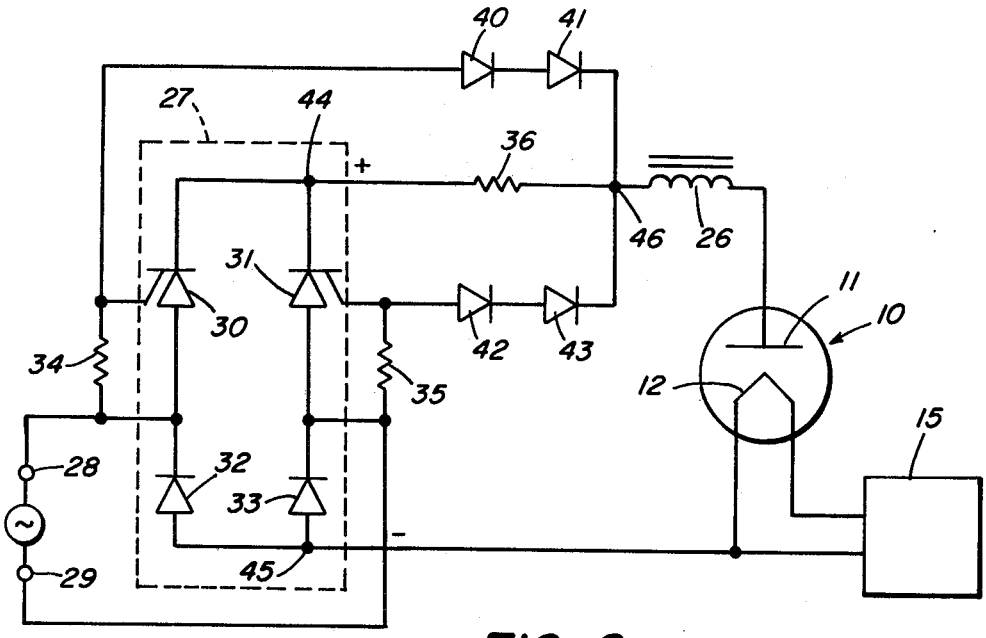
FIG. 2, is a schematic representation of an exemplary circuit embodying the invention.

The preferred embodiment of the invention is represented by the schematic diagram of FIG. 2. There is seen a direct current gas discharge device 10, such as a lamp, connected in series with inductor 26, resistor 36, and rectifier bridge 27. Device 10 incliudes an anode 11 and a cathode 12. Cathode 12 is heated by current from power supply 15. Rectified voltage is supplied from the output of rectifier bridge 27. The input of the bridge is connected to a source of alternating voltage at ports 28 and 29. It is a characteristics of gas discharge devices to have a constant voltage drop between anode 11 and cathode 12. Inductor 26 functions as a ballast, storing excess energy during those periods when applied voltage is greater than the device's voltage drop and discharging current when the applied voltage falls below the device's voltage drop. Resistor 36 is to sense current flowing through the circuit, specifically discharge current from inductor 26.

As a feature of the invention two thyristors, 30 and 31, and two rectifying diodes 32, 33 are connected for form the rectifier bridge 27. The anode of the thyristor 30 and the cathode of diode 32 are connected to port 28. The anode of thyristor 31 and the cathode of diode 33 are connected to port 29. The cathodes of thyristors 30 and 31 are connected together and form the positive output terminal 44 of the bridge. The anodes of diodes 32 and 33 are connected together and form the negative output terminal 45 of the bridge.

Thyristor 30 is supplied gate turn on current from resistor 34 which is in series between port 28 and the gate of thyristor 30. Likewise, thyristor 31 is supplied gate turn on current from resistor 35 which is in series between port 29 and the gate of thyristor 31.

Resistor 36 is in series with the cathodes of thyristors 30 and 31 and inductor 26. Any current flowing through inductor 26 will cause a voltage drop across resistor 36. Series diodes 40 and 41 are connected from the gate of thyristor 30 to the junction 46 of resistor 36 and inductor 26. Series diodes 42 and 43 are connected from the gate of thyristor 31 to the junction resistor 36 and inductor 26. The maximum total forward voltage drop across each pair of diodes is about 1.2 volts. If the thyristors are silicon controlled rectifiers, their gate to cathode voltage is about 0.6 volt.

Figure 1:
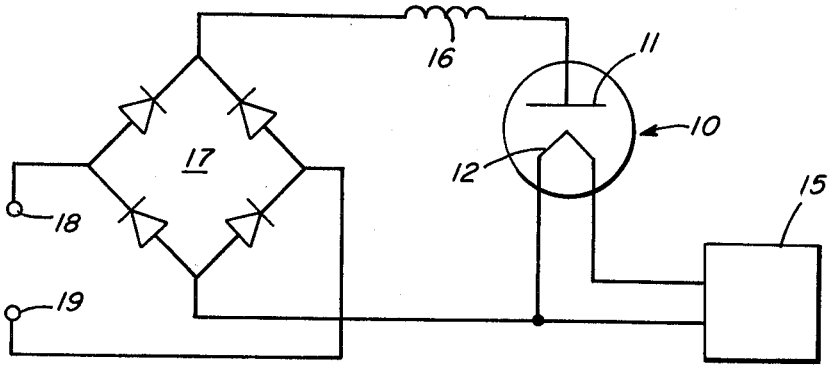
FIG. 1, referred to above, is a schematic drawing of a ballast circuit.

The thyristors 30, 31 receive gate current through resistors 34 and 35 respectively when the corresponding port is positive, unless the voltage drop across resistor 36 exceeds approximately 0.6 volt, at which point the gate current is diverted through diodes 40 and 41 or diodes 42 and 43. This arrangement allows the discharge current from inductor 26 to fall below a predetermined value and eliminated the excessive current excursion of the circuit of FIG. 1, discussed earlier.

Operation of the circuit is dependent upon the commutation between the two thyristors on alternating half-cycles and the delay of commutation in response to decay of energy stored in the inductor.

The functions of the circuit shall now be followed for a complete cycle of alternating current. The starting point is arbitrary but we shall begin during the half-cycle when port 29 is negative and port 28 is positive. Rectified voltage is supplied by the rectifier bridge 27. Current from thyristor 30 and diode 33 flows in series through resistor 36, inductor 26, and lamp 10. For most of the half-cycle the voltage across the lamp is less than that supplied by rectifier bridge 27. Any voltage difference appears across the inductor 26 which stores excess electrical energy. Towards the end of the half-cycle, bridge voltage drops and the inductor starts to discharge its stored energy in the form of current through the lamp 10, diode 32, thyristor 30 and resistor 36.

Continuing in time, the supply voltage drops to zero and then reverse polarity starting the next half-cycle. Port 28 is then negative and port 29 is negative. Discharge current from inductor 26 continues to flow through diode 32, thyristor 30 and resistor 36. If the voltage drop across resistor 36 is greater than 0.6 volts, gating current from resistor 35 is diverted through diodes 42 and 43 bypassing the thyristor and delaying the start of the rectified half-cycle. When the inductor is sufficiently discharged for voltage across resistor 36 to drop below 0.6 volts, gate current flows through thyristor 31 causing it to trigger into the on state at which point the current in thyristor 30 ceases. In this way the necessary thyristor turn off is achieved and the thyristors are commutated each half-cycle.

The bridge 27 now supplies rectified voltage to the lamp 10 for the remainder of the half-cycle. The inductor 26 stores excess energy. The supply voltage again drops to zero. On the next half-cycle the functions of the thyristors are reversed. Inductor 26 continues to discharge through diode 33 and thyristor 31 until the voltage across resistor 36 drops below 0.6 volt. Thyristor 30 is then gated on, completing the cycle.

Inductor 26 can be similar in construction to the series ballast commonly used with ac operated fluorescent lamps, that is, it can consist of a laminated core of silicon steel with an air gap to avoid magnetic saturation, and wound with insulated copper wire to give the desired inductance value. But, because it is being used with unidirectional current when ballasting the dc discharge, it is possible, but not necessary, to use permanent magnetic biasing of the iron core, thereby making better use of the magnetization curve of the core material. This technique, applied to ferrite cores, is described in U.S. Pat. Nos. 3,968,465 and 4,009,460. It should thereby be possible to reduce the size and weight of the magnetic core by a factor of two over a comparable ac ballast. Thus, there has been described an exemplary circuit which controls the delayed triggering of a commutated pair of thyristors in response to the decay of the energy content of an inductive ballast. Modifications and variations of the circuit are apparent and are intended to be within the scope of the invention as defined by the claims.

I claim:

1. A ballast circuit for gaseous electrical discharge devices comprised of (a) means for connecting said circuit to a gaseous discharge device;

(b) an inductor in series with said device for storing excess energy;

(c) a rectifier bridge having positive and negative outputs and having ports for coupling to a source of alternating voltage, said bridge including: a first and a second thyristor, each thyristor having an anode, a cathode and a gate, and a maximum gate to cathode voltage drop; and a first and second rectifying diode;

the cathode of said thyristors connected together and forming the positive output of the bridge;

the anodes of the diodes connected together and forming the negative output of the bridge;

the anode of the first thyristor and the cathode of the first diode connected together and to one input port;

the anode of the second thyristor and the cathode of the second diode connected together and to another input port;

(d) means for coupling said input ports to a source of alternating voltage;

(e) a resistor connected between the connected cathodes of said thyristors and said inductor;

(f) means for supplying a voltage to the gate of said first thyristor;

(g) means for supplying a voltage to the gate of said second thyristor;

(h) first diverting means connected between the gate of said first thyristor and the junction of said resistor and said inductor; and (i) second diverting means connected between the gate of said second thyristor and the junction of said resistor and inductor, each diverting means having a maximum voltage drop and diverts gate current from its corresponding thyristor when the sum of the voltage drops across gate and cathode of the corresponding thyristor and said resistor exceed voltage drop of the diverting means.

2. The ballast circuit of claim 1 wherein each of said diverting means is a pair of series connected diodes having a forward voltage drop.

3. The ballast circuit of claim 1 wherein said gaseous discharge device is a lamp.

* * * * *